United States Patent [19]

Faulring et al.

[11] Patent Number: 4,483,710

[45] Date of Patent: Nov. 20, 1984

[54] ADDITION AGENT FOR ADDING VANADIUM TO IRON BASE ALLOYS

[75] Inventors: Gloria M. Faulring, Niagara Falls, N.Y.; Alan Fitzgibbon, Gibsonia, Pa.; Anthony F. Nasiadka, Lockport, N.Y.

[73] Assignee: Union Carbide Corporation, Danbury, Conn.

[21] Appl. No.: 460,871

[22] Filed: Jan. 25, 1983

Related U.S. Application Data

[63] Continuation-in-part of Ser. No. 249,503, Mar. 31, 1981, Pat. No. 4,396,425.

[51] Int. Cl.[3] ..... C21C 7/00

[52] U.S. Cl. ..... 75/129; 75/53

[58] Field of Search ..... 75/129, 53

[56] References Cited

U.S. PATENT DOCUMENTS

| | | | |
|---|---|---|---|
| 2,805,147 | 9/1957 | Schreiber | 75/53 |
| 2,836,486 | 5/1958 | Brennan et al. | 75/27 |
| 2,935,397 | 5/1960 | Saunders et al. | 75/44 |
| 2,999,749 | 9/1961 | Saunders et al. | 75/58 |
| 3,194,649 | 7/1965 | Okazaki | 75/27 |
| 3,579,328 | 5/1971 | Aas et al. | 75/133.5 |
| 3,591,367 | 7/1971 | Perfect | 75/133 |
| 3,885,957 | 5/1975 | Richter | 75/53 |
| 3,929,464 | 12/1975 | Todd | 75/53 |
| 3,955,966 | 5/1976 | Meichsner | 75/53 |
| 3,998,625 | 12/1976 | Koros | 75/53 |
| 4,040,814 | 8/1977 | Merker | 75/129 |
| 4,071,355 | 1/1978 | Staggers | 75/30 |
| 4,167,409 | 9/1979 | Downing | 75/129 |
| 4,277,279 | 7/1981 | Kerlin | 75/53 |
| 4,286,984 | 9/1981 | Luyckx | 75/53 |
| 4,298,192 | 11/1981 | Barbakadze | 75/53 |
| 4,361,442 | 11/1982 | Faulring | 75/129 |

FOREIGN PATENT DOCUMENTS

| | | |
|---|---|---|
| 833098 | 4/1960 | United Kingdom . |

*Primary Examiner*—Peter D. Rosenberg
*Attorney, Agent, or Firm*—John R. Doherty

[57] ABSTRACT

Addition of vanadium to molten iron-base alloys using an agglomerated mixture of $V_2O_3$ and calcium-bearing reducing agent. The mixture is added to the molten alloy by pneumatic injection with a carrier gas such as argon or nitrogen.

8 Claims, 4 Drawing Figures

Ca Distribution

Electron Image

Al Distribution

ADDITION AGENT FOR ADDING VANADIUM TO IRON BASE ALLOYS

This application is a continuation-in-part of my earlier filed co-pending application Ser. No. 249,503 filed Mar. 31, 1981, now U.S. Pat. No. 4,396,425, issued on Aug. 2, 1983.

The present invention is related to the addition of vanadium to molten iron-base alloys, e.g., steel. More particularly, the present invention is directed to an addition agent comprising $V_2O_3$ and a calcium-bearing reducing agent.

It is a common requirement in the manufacture of iron base alloys, e.g., steel, to make additions of vanadium to the molten alloy.

Previous commercial techniques have involved the use of ferrovanadium alloys and vanadium and carbon, and vanadium, carbon and nitrogen containing materials as disclosed in U.S. Pat. No. 3,040,814.

Such materials, while highly effective in many respects, require processing techniques that result in aluminium, carbon and nitrogen containing additions and consequently, cannot be satisfactorily employed in all applications, e.g., the manufacture of pipe steels and quality forging grades of steel.

Pelletized mixtures of $V_2O_5$ plus aluminum; $V_2O_5$ plus silicon plus calcium-silicon alloy; $V_2O_5$ plus aluminium plus calcium-silicon, and "red-cake" plus 21%, 34% or 50% calcium-silicon alloy have been previously examined as a source of vanadium in steel by placing such materials on the surface of molten steel. The "red-cake" used was a hydrated sodium vanadate containing 85% $V_2O_5$, 9% $Na_2O$ and 2.5% $H_2O$. The results were inconclusive, probably due to oxidation and surface slag interference.

It is therefore an object of the present invention to provide a vanadium addition for iron base alloys, especially a vanadium addition that does not require energy in preparation and which enables, if desired, the efficient addition of the vanadium metal constitutent without adding carbon or nitrogen.

Another object of the present invention is to provide such a vanadium addition which, due to its low density, is amenable to pneumatic injection into a molten iron base alloy with a carrier gas and which makes possible high recoveries and absolute control of processing conditions.

Figure 1:
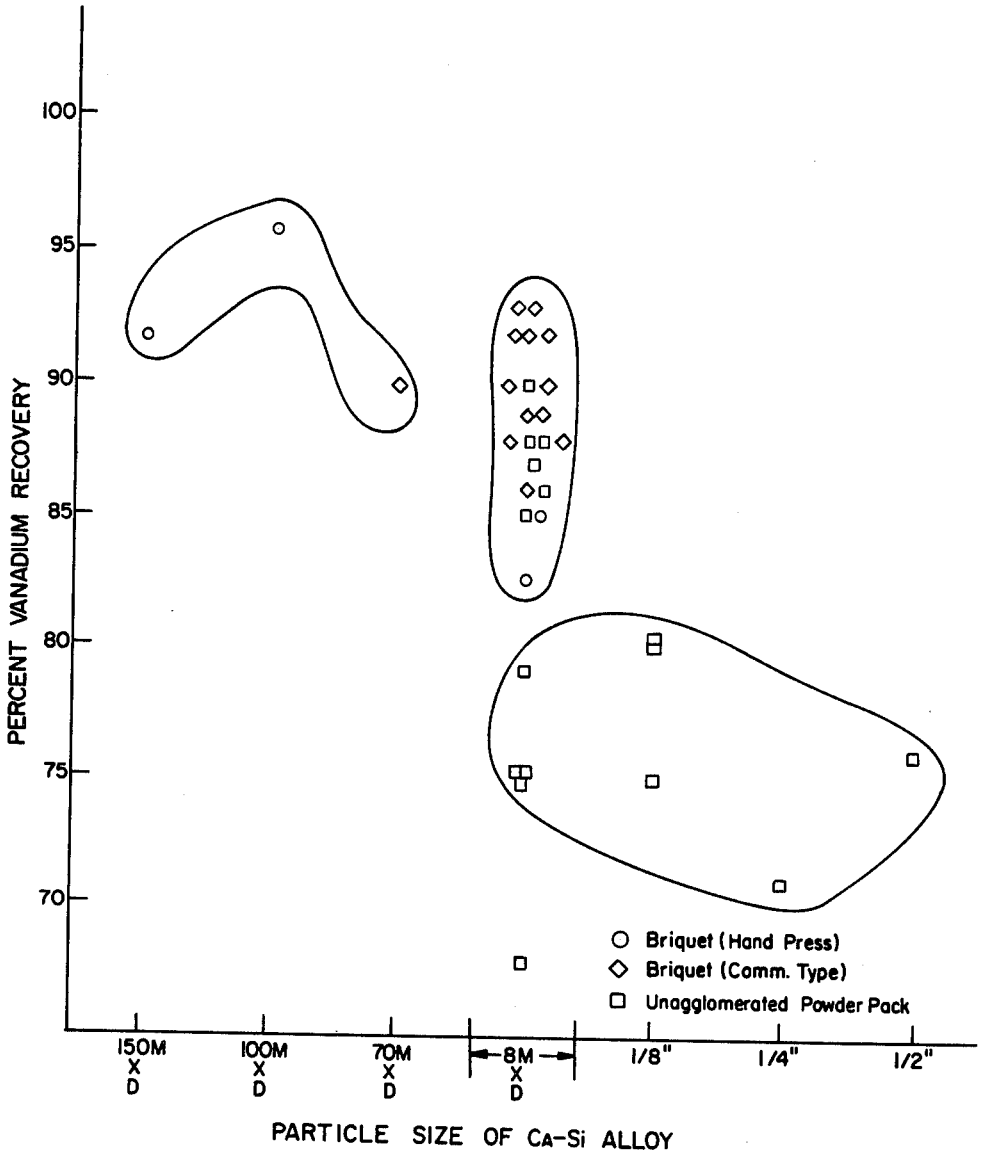
Figure 2B:
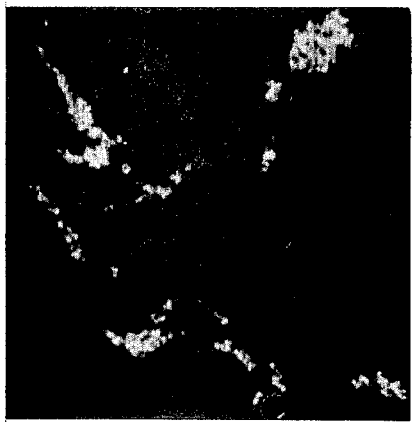
Figure 2A:
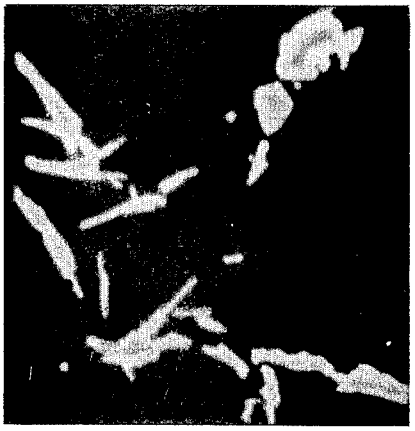
Figure 2C:
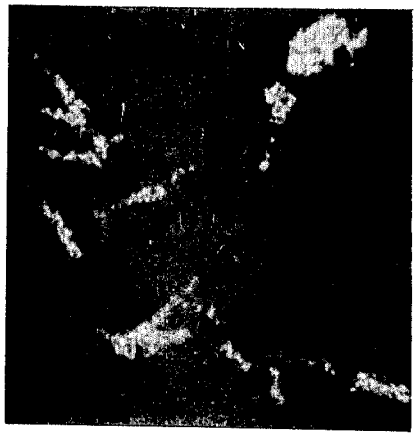

Other objects will be apparent from the following descriptions and claims taken in conjunction with the drawing wherein FIG. 1 is a graph showing the effect of particle sizing on vanadium recovery and FIG. 2 (*a*)-(*c*), show electron probe analysis of steel treated in accordance with the present invention.

The vanadium addition agent of the present invention is a blended, agglomerated mixture consisting essentially of $V_2O_3$ (at least 95% by weight $V_2O_3$) and a calcium-bearing reducing agent. The mixture contains about 55 to 65% by weight of $V_2O_3$ and 35% to 45% by weight of calcium-bearing reducing agent. In a preferred embodiment of the present invention, the reducing agent is a calcium-silicon alloy, about 28–32% by weight Ca and 60–65% by weight Si, containing primarily the phases $CaSi_2$ and Si; the alloy may advantageously contain up to about 8% by weight iron, aluminum, barium, and other impurities incidental to the manufacturing process, i.e., the manufacture of calcium-silicon alloy by the electric furnace reduction of CaO and $SiO_2$ with carbon. (Typical analysis: Ca 28–32%, Si 60–65%, Fe 5.0%, Al 1.25%, Ba 1.0%, and small amounts of impurity elements.)

In the practice of the present invention a blended, agglomerated mixture of $V_2O_3$ and calcium-silicon alloy is prepared in substantially the following proportions: 50% to 70%, preferably 55% to 65% by weight $V_2O_3$ and 30% to 50%, preferably 35% to 45% by weight calcium-silicon alloy. The particle size of the calcium-silicon alloy is predominantly (more than 90%) 8 mesh and finer (8M×D) and the $V_2O_3$ is sized predominantly (more than 90%) 100 mesh and finer (100M×D).

The mixture is thoroughly blended and thereafter agglomerated, e.g., by conventional compacting techniques so that the particles of the $V_2O_3$ and reducing agent such as calcium-silicon alloy particles are closely associated in intimate contact. The closely associated agglomerated mixture is added to molten steel where the heat of the metal bath and the reducing power of the reducing agent are sufficient to activate the reduction of the $V_2O_3$. The metallic vanadium generated is immediately integrated into the molten metal.

It is important that the addition agent of the present invention be rapidly immersed in the molten metal to minimize any reaction with oxygen in the high temperature atmosphere above the molten metal which would oxidize the calcium-bearing reducing agent. Also, contact of the addition agent with any slag or slag-like materials on the surface of the molten metal should be avoided so that the reactivity of the addition is not diminished by coating or reaction with the slag. This may be accomplished by several methods. For example, by plunging the addition agent, encapsulated in a container, into the molten metal or by adding compacted mixture into the pouring stream during the transfer of the molten metal from the furnace to the ladle. In order to ensure rapid immersion of the addition agent into the molten metal, the ladle should be partially filled to a level of about one-quarter to one-third full before starting the addition, and the addition should be completed before the ladle is filled. The CaO and $SiO_2$ formed when the vanadium oxide is reduced enters the slag except when the steel is aluminum deoxidized. In that case, the CaO generated modifies the $Al_2O_3$ inclusions resulting from the aluminum deoxidation practice.

Another method of adding the addition agent to the molten iron-base alloy is to inject the addition agent into the molten alloy with a carrier gas. The carrier gas may be argon or nitrogen, for example. In addition to minimizing reaction with oxygen and avoiding contact with slag or slag-like material, this method offers several advantages, for example, when compared to ferrovanadium addition, the $V_2O_3$-CaSi mixture is about two and one-half times less dense than ferrovanadium. This is shown by the data below.

| Vanadium Addition | Apparent Density |
|---|---|
| Briquets, 60% $V_2O_3$ + 40% CaSi | 2.50 gm/cc |
| 60% FeV | 6.35 gm/cc |
| 80% FeV | 6.29 gm/cc |

Because the vanadium additive is less dense, the flow rate of the carrier gas-additive mixture can be significantly reduced, i.e., the weight of the heavier ferrovanadium is not a limiting factor. Therefore, greater control of the processing conditions is possible. In addition, the particle size of the additive mixture can be readily altered to suit the injection process by forming the mixture to a predetermined particle size during its preparation. This also provides for increased flexibility in the injection process. Typically, after its preparation as described above, the additive mixture should be reduced to a particle size in the range of from about 10 mesh up to about one-half inch. The concentration of the particles in the carrier gas may of course be varied over a wide range depending upon the particular particle size chosen.

$V_2O_3$ (33% O) is the preferred vanadium oxide source of vanadium because of its low oxygen content. Less calcium-bearing reducing agent is required for the reduction reaction on this account and, also a smaller amount of CaO and $SiO_2$ is generated upon addition to molten metal.

In addition, the melting temperature of the $V_2O_3$ (1970° C.) is high and thus, the $V_2O_3$ plus calcium-silicon alloy reduction reaction temperature closely approximates the temperature of molten steel (>1500° C.). Chemical and physical properties of $V_2O_3$ and $V_2O_5$ are tabulated in Table VI.

The following example further illustrates the present invention.

EXAMPLE

Procedure:

Armco iron was melted in a magnesia-lined induction furnace with argon flowing through a graphite cover. After the temperature was stabilized at 1600° C.±10° C., the heat was blocked with silicon. Next, except for the vanadium addition, the compositions of the heats were adjusted to the required grade. After stabilizing the temperature at 1600° C.±5° C. for one minute, a pintube sample was taken for analysis and then a vanadium addition was made by plunging a steel foil envelope containing the vanadium addition into the molten steel. The steel temperature was maintained at 1600° C.±5° C. with the power on the furnace for three minutes after addition of the $V_2O_3$ plus reducing agent mixture. Next, the power was shut off and after one minute, pintube samples were taken and the steel cast into a 100-pound, $10.2_{cm}^2$ (4 in)$^2$ ingot. Subsequently, specimens removed from mid-radius the ingot, one-third up from the bottom, were examined microscopically and analyzed chemically. Some were analyzed on the electron microprote.

Various mixtures of $V_2O_3$ plus reducing agent were added as a source of vanadium in molten steel having different compositions. In Table I, the results are arranged in order of increasing vanadium recoveries for each of the steel compositions. The data in Table II compares the vanadium recoveries for various grades of steel when the vanadium additions were $V_2O_3$ plus calcium-silicon alloy (8M×D) mixtures compacted under different conditions representing different pressures, and in Table III, when the particle size of the calcium-silicon alloy was the principal variable. In order to more completely characterize the preferred $V_2O_3$ plus calcium-silicon alloy addition mixture, the particle size distribution of the commercial grade calcium-silicon alloy (8M×D) is presented in Table IV. It may be noted that 67% is less than 12 mesh and 45% less than 20 mesh. As shown in FIG. 1, finer particle size fractions of the calcium-silicon alloy are efficient in reducing the $V_2O_3$, however, the 8M×D fraction is not only a more economical but also a less hazardous product to produce than the finer fractions.

In some grades of steel, the addition of carbon or carbon and nitrogen is either acceptable or beneficial. Vanadium as well as carbon or carbon plus nitrogen can also be added to these steels by reducing the $V_2O_3$ with $CaC_2$ or $CaCN_2$ as shown in Table V.

As noted above, Table I represents the experimental heats arranged in order of increasing vanadium recoveries for each steel composition. It may be noted that reducing agents such as aluminum and aluminum with various fluxes, will reduce $V_2O_3$ in molten steel. However, for all of these mixtures, the vanadium recoveries in the steels were less than 80 percent.

As shown in Table I and FIG. 1, optimum vanadium recoveries were recorded when the vanadium source was a closely associated mixture of 60% $V_2O_3$ (100M×D) plus 40% calcium-silicon alloy (8M×D). It may also be noted in Table I that the vanadium recoveries are independent of the steel compositions. This is particularly evident in Table II where the vanadium recovery from the 60% $V_2O_3$ plus 40% calcium-silicon alloy, 8M×D, mixtures exceeded 80% in aluminum-killed steels (0.08–0.22% C), semi-killed steels (0.18–0.30%), and plain carbon steels (0.10–0.40% C). Moreover, Table II shows that the vanadium recovery gradually improved when the 60% $V_2O_3$ plus 40% calcium-silicon alloy (8M×D) was briquetted by a commercial-type process using a binder instead of being packed by hand in the steel foil immersion envelopes. In other words, the close association of the $V_2O_3$ plus calcium-silicon alloy mixture that characterizes commercial-type briquetting with a binder improves vanadium recoveries. For example, the heats with the addition methods emphasized by squarelike enclosures in Table II were made as duplicate heats except for the preparation of the addition mixture. In all but one pair of heats, the vanadium recoveries from the commercial-type briquets were superior to tightly packing the mixture in the steel foil envelopes.

The data in Table III show the effect of the particle size of the reducing agent, calcium-silicon alloy, in optimizing the vanadium recoveries. Again, the vanadium recoveries were independent of the steel compositions and maximized when the particle size of the calcium-silicon alloy was 8M×D or less as illustrated in the graph of FIG. 1. Although high vanadium recoveries >90%, were measured when the particle size ranges of the calcium-silicon alloy were 150M×D and 100M×D, the potential hazards and costs related to the production of these size ranges limit their commercial applications. For this reason, 8M×D calcium-silicon alloy has optimum properties for the present invention. The particle size distribution of commercial grade 8M×D is shown in Table IV.

When small increases in the carbon or carbon-plus-nitrogen contents of the steel are either acceptable or advantageous for the steel maker, $CaC_2$ and/or $CaCN_2$ can be employed as the reducing agent instead of the calcium-silicon alloy. It has been found that commercial grade $CaC_2$ and $CaCN_2$ are also effective in reducing $V_2O_3$ and adding not only vanadium but also carbon or carbon and nitrogen to the molten steel. The results listed in Table V show the vanadium recoveries and increases in carbon and nitrogen contents of the molten steel after the addition of $V_2O_3$ plus $CaC_2$ and $V_2O_3$ plus $CaCN_2$ mixtures.

Specimens removed from the ingots were analyzed chemically and also examined optically. Frequently, the inclusions in the polished sections were analyzed on the electron microprobe. During this examination, it was determined that the CaO generated by the reduction reaction modifies the alumina inclusions characteristic of aluminum-deoxidized steels; for example, see the electron probe illustrations of FIG. 2 where the contained calcium and aluminum co-occur in the inclusions. Thus, the addition of the $V_2O_3$ plus calcium-bearing reducing agent to molten steel in accordance with present invention is not only a source of vanadium but also the calcium oxide generated modifies the detrimental effects of alumina inclusions in aluminum-deoxidized steels. The degree of modification depends on the relative amounts of the CaO and $Al_2O_3$ in the molten steel.

In view of the foregoing it can be seen that a closely associated agglomerated mixture of $V_2O_3$ and calcium-bearing reducing agent is an effective, energy efficient source of vanadium when immersed in molten steel.

The mesh sizes referred herein are United States Screen series.

TABLE I

Vanadium Additives for Steel

| Type Steel | Heat No. | Source(1) % $V_2O_3$ | Reducing Agent(2) Identity | % Wt. | Particle Size | V Addition Method(3) | % V Added | % V Recovered Furnace - "3-Min." | % C |
|---|---|---|---|---|---|---|---|---|---|
| Low Carbon: | | | | | | | | | |
| 0.036–0.5% Al | J635 | 65 | Al | 32 | Powder | P | 0.25 | 4 | |
| 0.10–0.12% C | | | +3% | 40% Cryolite | | | | | |
| 0.16–0.31% Si | | | Flux | +60% $CaF_2$ (oil) | | | | | |
| 1.50–1.60% Mn | J636 | 67 | $CaF_2$ (Flux) | 3 | | | | | |
| | | | Al | 30 | Powder | P | 0.25 | 10 | |
| | J639 | 65 | Al | 35 | 7–100 M (Granules) | P | 0.25 | 36 | |
| | J637 | 65 | Al | 35 | Shot | P | 0.25 | 52 | |
| | J647 | 60 | "Hypercal" | 40 | ⅛" | P | 0.25 | 64 | |
| | J645 | 60 | CaSi | 40 | ¼" | P | 0.25 | 72 | |
| | J676 | 60 | CaSi | 40 | ½" | P | 0.25 | 76 | |
| | J644 | 60 | CaSi | 40 | ⅛" | P | 0.25 | 80 | |
| | J641 | 60 | CaSi | 40 | ⅛" | P | 0.25 | 80 | |
| | J619 | 65 | CaSi | 35 | 8 M × D | P | 0.13 | 80 | |
| | J615 | 50 | CaSi | 50 | 8 M × D | P | 0.13 | 85 | |
| | J614 | 55 | CaSi | 45 | 8 M × D | P | 0.13 | 87 | |
| | J620 | 60 | CaSi | 40 | 8 M × D | P | 0.13 | 88 | |
| | J798 | 60 | CaSi | 40 | 150 M × D | B | 0.25 | 92 | |
| | J800 | 60 | CaSi | 40 | 8 M × D | BC | 0.25 | 92 | |
| | J799 | 60 | CaSi | 40 | 100 M × D | B | 0.25 | 96 | |
| Carbon Steels: | J654 | 60 | CaSi | 40 | ⅛" | P | 0.20 | 75 | |
| 0.03–0.07% Al | J672 | 65 | $CaC_2$ | 35 | ¼" × 1/12" | P | 0.20 | 76 | |
| 0.23–0.29% C | J671 | 55 | $CaC_2$ | 45 | ¼" × 1/12" | P | 0.20 | 77 | |
| 0.27–0.33% Si | J669 | 65 | CaSi | 35 | 8 M × D | P | 0.20 | 79 | |
| 1.35–1.60% Mn | J670 | 70 | CaSi | 30 | 8 M × D | P | 0.20 | 81 | |
| | J657 | 60 | $Ca_2$ | 40 | 1/12" × ¼" | P | 0.20 | 83 | |
| | J656 | 60 | CaSi | 40 | 8 M × D | P | 0.20 | 87 | |
| | J655 | 60 | CaSi | 40 | 8 M × D | P | 0.20 | 90 | |
| Carbon Steels: | J678* | 60 | $CaCN_2$ | 40 | <325 M | P | 0.20 | 50 | |
| 0.04–0.07% Al | J677* | 65 | $CaCN_2$ | 35 | <325 M | P | 0.20 | 55 | |
| 0.15–0.20% C | J679* | 55 | $CaCN_2$ | 45 | <325 M | P | 0.20 | 60 | |
| 0.22–0.28% Si | J680* | 50 | $CaCN_2$ | 50 | <325 M | P | 0.20 | 60 | |
| 1.40–1.50% Mn | J674 | 65 | CaSi | 35 | 8 M × D | B | 0.20 | 80 | |
| | J675 | 60 | $CaC_2$ | 40 | 16 M × D | P | 0.20 | 85 | |
| | J676 | 65 | $CaC_2$ | 35 | 16 M × D | P | 0.20 | 85 | |
| | J673 | 60 | CaSi | 40 | 8 M × D | B | 0.20 | 85 | |
| Carbon Steels: | J634 | 60 | CaSi | 40 | 8 M × D | P | 0.25 | 68** | 0.08 |
| 0.03–0.07% Al | J699 | 60 | CaSi | 40 | 8 M × D | Loose | 0.20 | 81 | 0.17 |
| 0.27–0.33% Si | J673 | 60 | CaSi | 40 | 8 M × D | B | 0.20 | 85 | 0.13 |
| 1.35–1.60% Mn | J714 | 60 | CaSi | 40 | 8 M × D | P | 0.20 | 86 | 0.16 |
| | J734 | 60 | CaSi | 40 | 8 M × D | BC | 0.19 | 89 | 0.08 |
| | J747 | 60 | CaSi | 40 | 8 M × D | BC | 0.21 | 90 | 0.10 |
| Semi-Killed: | J709 | 60 | CaSi | 40 | 8 M × D | P | 0.149 | 75 | 0.30 |
| 0.07–0.12% Si | J708 | 60 | CaSi | 40 | 8 M × D | P | 0.15 | 75 | 0.21 |
| 0.62–0.71% Mn | J707 | 60 | CaSi | 40 | 8 M × D | P | 0.16 | 79 | 0.16 |
| | J702 | 60 | CaSi | 40 | 8 M × D | BC | 0.15 | 89 | 0.38 |
| | J735 | 60 | CaSi | 40 | 70 M × D | BC | 0.20 | 90 | 0.08 |
| | J700 | 60 | CaSi | 40 | 8 M × D | BC | 0.16 | 93 | 0.10 |
| | J701 | 60 | CaSi | 40 | 8 M × D | BC | 0.16 | 93 | 0.25 |
| Plain Carbon: | J710 | 60 | CaSi | 40 | 8 M × D | P | 0.15 | 75 | 0.10 |
| 0.19–0.29% Si | J711 | 60 | CaSi | 40 | 8 M × D | P | 0.17 | 85 | 0.20 |
| 0.54–0.85% Mn | J713 | 60 | CaSi | 40 | 8 M × D | BC | 0.17 | 86 | 0.38 |
| | J706 | 60 | CaSi | 40 | 8 M × D | BC | 0.15 | 88 | 0.40 |
| | J705 | 60 | CaSi | 40 | 8 M × D | BC | 0.15 | 88 | 0.31 |
| | J703 | 60 | CaSi | 40 | 8 M × D | BC | 0.15 | 90 | 0.11 |
| | J712 | 60 | CaSi | 40 | 8 M × D | P | 0.18 | 92 | 0.29 |

TABLE I-continued

Vanadium Additives for Steel

| Type Steel | Heat No. | Source(1) % $V_2O_3$ | Reducing Agent(2) Identity | % Wt. | Particle Size | V Addition Method(3) | % V Added | % V Recovered Furnace - "3-Min." | % C |
|---|---|---|---|---|---|---|---|---|---|
| | J704 | 60 | CaSi | 40 | 8 M × D | BC | 0.16 | 92 | 0.18 |

(1)Vanadium Source: $V_2O_3$ - >99% pure, 100 M × D (commercial product, UCC).
(2)Reducing Agents:
CaSi Alloy - 29.5% Ca, 62.5% Si, 4.5% Fe, trace amounts of Mn, Ba, Al, C, etc. (commercial product UCC).
$CaN_2$ - >99% pure, 325 M × D (chemical reagent).
$CaC_2$ - Foundry grade, 66.5% $CaC_2$ (commercial product UCC) - (¼" × 1/12" particle size).
Al Powder - Alcoa Grade No. 12-1978.
"Hypercal" - 10.5% Ca, 39% Si, 10.3% Ba, 20% Al, 18% Fe.
(3) B: Briquetted in hand press - no binder.
P: Tightly packed in steel foil envelope.
Loose: Placed in immersion capsule - not packed.
BC: Briquetted by commercial type practice with binder.
} All additions made by plunging the vanadium addition mixtures into the molten steel inmx,1 low-carbon steel foil envelopes.

*About 10 pounds of metal thrown from the furnace when the $V_2O_3$ + $CaCN_2$ was plunged.
**Presumed erratic result

TABLE II

Effect of Packing Density and Steel Compositions on Vanadium Recoveries
Vanadium Source: 60% $V_2O_3$ + 40% CaSi (8 M × D)

| Heat No. | % Y Added | Addition Method* | Composition of Furnace "3 Minute" Pintube (Steel) % C | % Si | % Al | % Mn | % V | % V Recovery | |
|---|---|---|---|---|---|---|---|---|---|
| **J634 | 0.25 | P | 0.077 | 0.24 | 0.057 | 1.49 | 0.16 | 68 | Al-Killed increasing C content |
| J620 | 0.13 | P | 0.085 | 0.30 | 0.059 | 1.51 | 0.114 | 88 | |
| J673 | 0.20 | B | 0.130 | 0.23 | 0.074 | 1.51 | 0.17 | 85 | |
| J714 | 0.20 | P | 0.16 | 0.275 | 0.061 | 1.514 | 0.172 | 86 | |
| J699 | 0.20 | No P | 0.17 | 0.284 | 0.063 | 1.609 | 0.161 | 81 | |
| J655 | 0.20 | P | 0.21 | 0.29 | 0.055 | 1.64 | 0.180 | 90 | |
| J656 | 0.20 | P | 0.22 | 0.32 | 0.05 | 1.69 | 0.17 | 87 | |
| JZ734 | 0.186 | BC | | 0.16 | No Al Added | 0.50 | 0.165 | 89 | Semi-Killed increasing C content |
| J747 | 0.2052 | BC | 0.08 | 0.39 | | 0.82 | 0.19 | 93 | |
| | | | 0.10 | | | | | | |
| J700 | 0.172 | BC | 0.18 | 0.069 | | 0.657 | 0.16 | 93 | |
| J707 | 0.20 | P | 0.16 | 0.107 | | 0.704 | 0.158 | 79 | |
| J701 | 0.172 | BC | 0.25 | 0.069 | | 0.64 | 0.16 | 93 | |
| J708 | 0.20 | P | 0.21 | 0.106 | | 0.704 | 0.15 | 75 | |
| J702 | 0.172 | BC | 0.38 | 0.067 | No Al Added | 0.708 | 0.153 | 89 | |
| J709 | 0.20 | P | 0.30 | 0.121 | | 0.626 | 0,149 | 75 | |
| J703 | 0.172 | BC | 0.11 | 0.21 | | 0.543 | 0.154 | 90 | Plain C increasing |
| J710 | 0.20 | P | 0.10 | 0.245 | | 0.573 | 0.15 | 75 | |
| J704 | 0.172 | BC | 0.18 | 0.195 | | 0.543 | 0.159 | 92 | |
| J711 | 0.20 | P | 0.20 | 0.287 | | 0.616 | 0.17 | 85 | |
| J705 | 0.172 | BC | 0.31 | 0.233 | | 0.873 | 0.152 | 88 | Plain C increasing C content |
| J712 | 0.20 | P | 0.29 | 0.253 | | 0.861 | 0.183 | 92 | |
| J706 | 0.172 | BC | 0.40 | 0.224 | | 0.831 | 0.152 | 88 | |
| J713 | 0.20 | P | 0.38 | 0.252 | | 0.845 | 0.172 | 86 | |

*The vanadium additions were made by plunging steel foil envelopes containing the 60% $V_2O_3$ + 40% calcium-silicon mixtures into molten steel (1660° C. ± 5° C.). The mixtures were placed in envelopes as [1] tightly packed mix (P); [2] not packed (no P); [3] briquets made in a hand press, no binder (B); or [4] commercial-type briquets made on a briquetting machine with a binder (BC).
**presumed erratic result

TABLE III

Influence of Calcium-Silicon Alloy Particle Size on the Recovery of Vanadium from Vanadium Oxide in Steel

| | | V Source | | CaSI | | | | |
|---|---|---|---|---|---|---|---|---|
| | | Heat No. | % $V_2O_3$ | % | Particle Size | Addition Method* | % V Added | % V Recovered |
| Low Carbon: | 0.036–0.05% Al, 0.10–0.12% C, | J798 | 60 | 40 | 150 M × 0 | B | 0.25 | 92 |
| | 0.16–0.31% Si, 1.50–1.60% Mn | J799 | 60 | 40 | 100 M × 0 | B | 0.25 | 96 |
| | | J800 | 60 | 40 | 8 M × D | C | 0.25 | 92 |
| | | J645 | 60 | 40 | ¼" | P | 0.25 | 72 |
| | | J646 | 60 | 40 | ½" | P | 0.25 | 76 |
| | | J644 | 60 | 40 | ⅛" | P | 0.25 | 80 |
| | | J641 | 60 | 40 | ⅛" | P | 0.25 | 80 |
| | | J640 | 60 | 40 | 8 M × D | P | 0.13 | 88 |
| Carbon Steels: | 0.04–0.07% Al, 0.23–0.29% C, | J654 | 60 | 40 | ⅛" | P | 0.20 | 75 |
| | 0.27–0.33% Si, 1.35–1.60% Mn | J656 | 60 | 40 | 8 M × D | P | 0.20 | 87 |
| | | J655 | 60 | 40 | 8 M × D | | 0.20 | 90 |
| Semi-Killed: | 0.19–0.40% Si, | J735 | 60 | 40 | 70 M × D | BC | 0.195 | 90 |
| | 0.60–0.80% Mn, 0.08–0.10% C | J747 | 60 | 40 | 70 M × D | BC | 0.205 | 93 |

*P: Tightly packed in steel foil envelope.
B: Briquets made by hand in a press and packed in steel foil envelope.
BC: Commercial-type briquets made in a briquetting machine and packed in steel foil envelope.
} Added by plunging into molten steel at 1600° C. ± 5° C.

TABLE IV

Particle Size Distribution of Calcium-Silicon Alloy (8 Mesh × Down)

| |
|---|
| 6 Mesh - Maximum |
| 4% on 8 M |
| 33% on 12 M |
| 55% on 20 M |
| 68% on 32 M |
| 78% on 48 M |
| 85% on 65 M |
| 89% on 100 M |
| 93% on 150 M |
| 95% on 200 M |

Products of Union Carbide Corporation, Metals Division

TABLE VI-continued

Comparison of Properties of $V_2O_5$

| Property | $V_2O_3$ | $V_2O_5$ | Reference |
|---|---|---|---|
| | Rhombohedral | $c_o = 3.563 \pm 3$ A Orthohrombic | |

We claim:

1. In a method of treating a molten iron-base alloy with an additive material by injecting finely divided particles of said additive material into said molten alloy with a carrier gas stream, the improvement which comprises injecting an agglomerated blended mixture of about 50 to 70% by weight of finely divided $V_2O_3$ with about 30 to 50% by weight of a finely divided calcium-bearing material selected from the group consisting of calcium-silicon alloy, calcium carbide and calcium cyanamide.

2. The improvement according to claim 1 wherein the carrier gas is selected from the group consisting of argon and nitrogen.

3. The improvement according to claim 1 wherein the particle size of said agglomerated, blended mixture is from about 10 mesh up to about one-half inch.

4. A method for adding vanadium to molten iron-base alloy which comprises preparing an agglomerated, blended mixture of about 50 to 70% by weight of finely

TABLE V

Vanadium Additives for Steel Containing Carbons or Carbon Plus Nitrogen

| | | | Reducing Agent(2) | | | V | | % V | | N |
|---|---|---|---|---|---|---|---|---|---|---|
| Carbon Steel: | Heat No. | % $V_2O_3$(1) | Identity | % | Particle Size | Addition Method(3) | % V Added | Recovered Furnace | % C Inc.(4) | (ppm) Inc.(4) |
| 0.03–0.7% Al | J672 | 65 | $CaC_2$ | 35 | ¼" × ½" | P | 0.20 | 76 | 0.02 | |
| 0.23–0.29% C | J671 | 55 | $CaC_2$ | 45 | ¼" × ½" | P | 0.20 | 77 | 0.03 | |
| 0.27–0.33% Si | J657 | 60 | $CaC_2$ | 40 | ½" × ¼" | P | 0.20 | 83 | 0.03 | |
| 1.35–1.60% Mn | | | | | | | | | | |
| 0.04–0.07% Al | J678* | 60 | $CaCn_2$ | 40 | <200 M | P | 0.20 | 50 | 0.02 | 120 |
| 0.15–0.20% C | J677* | 65 | $CaCn_2$ | 35 | <200 M | P | 0.20 | 55 | 0.01 | 102 |
| 0.22–0.28% Si | J679* | 55 | $CaCn_2$ | 45 | <200 M | P | 0.20 | 60 | 0.03 | 194 |
| 1.40–1.50% Mn | J680* | 50 | $CaCN_2$ | 50 | <200 M | P | 0.20 | 60 | 0.03 | 225 |
| | J675 | 60 | $CaC_2$ | 40 | 16 M × D | P | 0.20 | 85 | 0.04 | |
| | J676 | 65 | $CaC_2$ | 35 | 16 M × D | P | 0.20 | 85 | 0.04 | |

(1)$V_2O_3$: 99% pure, 100 M × D (commercial product, UCC).
(2)$CaC_2$: 80% $CaC_2$, 14% CaO, 2.9% $SiO_2$, 1.6% $Al_2O_3$ (*commercial product, UCC*). *CaCn2*: 50% Ca, 15% C, 35% N (chemically pure).
(3)Mixture tightly packed in steel foil envelope and plunged into molten steel - 1600° C. ± 5° C.
(4)Increase in % C and ppm N in molten steel due to addition of vanadium plus $CaC_2$ or $CaCN_2$ mixture ("3-minute" pintube samples).
*About 10 pounds of metal thrown out of furnace due to violence of the reaction.

TABLE VI

Comparison of Properties of $V_2O_5$

| Property | $V_2O_3$ | $V_2O_5$ | Reference |
|---|---|---|---|
| Density | 4.87 | 3.36 | 1 |
| Melting Point | 1970° C. | 690° C. | 1 |
| Color | Black | Yellow | 1 |
| Character of Oxide | Basic | Amphoteric | 2 |
| Composition | 68% V + 32% O | 56% V + 44% O | (Calc.) |
| Free Energy of Formation (1900° K.) | −184,500 cal/mole | −202,000 cal/mole | 3 |
| Crystal Structure | $a_o = 5.45 \pm 3$ A<br>$\alpha = 54°49' \pm 8'$ | $a_o = 4.359 \pm 5$ A<br>$b_0 = 11.510 \pm 8$ A | 4 |

divided $V_2O_3$ with about 30 to 50% by weight of a finely divided calcium-bearing material selected from the group consisting of calcium-silicon alloy, calcium carbide and calcium cyanamide, reducing the agglomerated, blended mixture so prepared to a particle size in the range of from about 10 mesh up to about one-half inch, suspending the particles of said agglomerated, blended mixture in a carrier gas and then injecting the carrier gas-particle mixture pneumatically into the molten iron-base alloy.

5. A method according to claim 4 wherein the carrier gas is selected from the group consisting of argon and nitrogen.

6. A method according to claim 4 wherein said calcium-bearing material is calcium-silicon alloy.

7. A method according to claim 4 wherein said calcium-bearing material is calcium carbide.

8. A method according to claim 4 wherein said calcium-bearing material is calcium cyanamide.

* * * * *

UNITED STATES PATENT AND TRADEMARK OFFICE

CERTIFICATE OF CORRECTION

PATENT NO. : 4,483,710

DATED : November 20, 1984

INVENTOR(S) : Gloria M. Faulring, Alan Fitzgibbon and Anthony F. Nasiadka

It is certified that error appears in the above-identified patent and that said Letters Patent is hereby corrected as shown below:

In Table I, line 2, third heading "Source(1)" should read -- V Source (1) --.

In Table I, line 53, last column from left under heading "%C", "0.10" should read -- 0.18 --.

In Table I - continued (Columns 7 and 8), lines 14 and 15, "addition mixtures into the molten steel inmn, 1 low-carbon steel foil envelopes." should read -- addition mixtures into the molten steel in low-carbon steel foil envelopes -- .

In Table II, line 4, heading for second column, "%Y" should read -- %V --.

In Table II, line 16, first column, "JZ734" should read -- J734 --.

In Table II, line 16, fourth column under heading "%C", "0.08" should be inserted.

In Table II, line 17, fourth column under heading "%C", "0.10" should be inserted.

In Table II, line 18, fourth column under heading "%C", "0.08" should be deleted.

UNITED STATES PATENT AND TRADEMARK OFFICE

CERTIFICATE OF CORRECTION

PATENT NO. : 4,483,710

DATED : November 20, 1984

INVENTOR(S) : Gloria M. Faulring, Alan Fitzgibbon and Anthony F. Nasiadka

It is certified that error appears in the above-identified patent and that said Letters Patent is hereby corrected as shown below:

In Table II, Line 19, fourth column under heading "%C", "0.10" should be deleted.

In Table II, line 32, fifth column under heading "%Si", "0.067" should read -- 0.097 --.

In Table III, line 6, sixth column under heading "Particle Size", "150 M x O" should read -- 150 M x D --.

In Table III, line 7, sixth column under heading "Particle Size", "100 M x O" should read -- 150 M x D --.

In Table V, line 15, footnotes, "(1) $V_2O_3$: 99%" should read -- (1) $V_2O_3$ : > 99% --.

Signed and Sealed this

*Twenty-fourth* Day of *September 1985*

[SEAL]

*Attest:*

*Attesting Officer*

DONALD J. QUIGG

*Commissioner of Patents and Trademarks—Designate*